US008338709B2

(12) United States Patent
Kodama et al.

(10) Patent No.: US 8,338,709 B2
(45) Date of Patent: Dec. 25, 2012

(54) FLEXIBLE FLAT CABLE

(75) Inventors: Shinya Kodama, Hitachi (JP); Nobuhito Akutsu, Hitachi (JP); Hidenori Kobayashi, Hitachi (JP)

(73) Assignee: Hitachi Cable Fine-Tech, Ltd., Ibaraki (JP)

( * ) Notice: Subject to any disclaimer, the term of this patent is extended or adjusted under 35 U.S.C. 154(b) by 288 days.

(21) Appl. No.: 12/838,921

(22) Filed: Jul. 19, 2010

(65) Prior Publication Data

US 2011/0232938 A1 Sep. 29, 2011

(30) Foreign Application Priority Data

Mar. 26, 2010 (JP) ..... 2010-071299

(51) Int. Cl.
*H01B 7/00* (2006.01)

(52) U.S. Cl. ..... 174/110 R; 174/117 R; 174/117 F; 174/117 FF; 174/117 M

(58) Field of Classification Search ..... 174/110 R, 174/113 R, 117 R, 117 F, 117 FF, 120 R, 174/117 M, 36
See application file for complete search history.

(56) References Cited

U.S. PATENT DOCUMENTS

| | | | | |
|---|---|---|---|---|
| 3,612,744 | A * | 10/1971 | Thomas | 174/36 |
| 4,504,696 | A * | 3/1985 | Piper | 174/32 |
| 5,373,103 | A * | 12/1994 | Orr et al. | 174/36 |
| 5,416,268 | A * | 5/1995 | Ellis | 174/36 |
| 5,532,429 | A * | 7/1996 | Dickerson et al. | 174/36 |
| 7,399,929 | B2 * | 7/2008 | Ueno et al. | 174/117 FF |
| 7,807,927 | B2 * | 10/2010 | Yeh | 174/110 R |
| 2007/0193770 | A1 | 8/2007 | Ueno et al. | |
| 2010/0044077 | A1 | 2/2010 | Takamatsu et al. | |

FOREIGN PATENT DOCUMENTS

| | | |
|---|---|---|
| JP | 2002-184245 | 6/2002 |
| JP | 2003-031033 | 1/2003 |
| JP | 2005-339833 | 12/2005 |
| JP | 2008-277254 | 11/2008 |

* cited by examiner

*Primary Examiner* — William Mayo, III

(74) *Attorney, Agent, or Firm* — Scully, Scott, Murphy & Presser, P.C.

(57) ABSTRACT

A flexible flat cable includes a plurality of conductors arranged parallel at predetermined intervals, an insulation layer covering both sides of each of the plurality of conductors, a nonwoven fabric layer on an outer surface of the insulation layer, and a shield layer on an outer surface of the nonwoven fabric layer. The nonwoven fabric layer includes a nonwoven fabric including a layer including a first fiber thread with a predetermined outer diameter and a second fiber thread with an outer diameter larger than that of the first fiber thread. A basis weight of the nonwoven fabric is 50 to 90 g/m$^2$.

5 Claims, 4 Drawing Sheets

1 FLEXIBLE FLAT CABLE
2 CONDUCTOR
3 INSULATION LAYER
4 NONWOVEN FABRIC LAYER
5 SHIELD LAYER

| | |
|---|---|
| 1 FLEXIBLE FLAT CABLE | 41 NONWOVEN FABRIC |
| 2 CONDUCTOR | 51 INSULATING FILM |
| 31 INSULATING FILM | 52 METAL FOIL |
| 32,42,53 ADHESIVE | |

411 FIRST LAYER
412 SECOND LAYER
413 THIRD LAYER

1 FLEXIBLE FLAT CABLE
2 CONDUCTOR
3 INSULATION LAYER
4 NONWOVEN FABRIC LAYER
5 SHIELD LAYER
6 GROUND METAL LAYER
7 MEASURING PLUG

Prior Art

FLEXIBLE FLAT CABLE

The present application is based on Japanese Patent Application No. 2010-071299 filed on Mar. 26, 2010, the entire contents of which are incorporated herein by reference.

BACKGROUND OF THE INVENTION

1. Field of the Invention

The invention relates to a flexible flat cable and, in particular, to a flexible flat cable with a shield layer that is used as a wiring material of electric and electronic devices such as audio-video devices and office automation devices.

2. Description of the Related Art

In general, a flexible flat cable is widely used as a jumper wire (or a fixed wiring) between circuits in various electric and electronic devices or as a wiring material wired to a movable portion in the electric and electronic devices in place of a flexible printed-wiring board because of its flexibility (or bendability). In recent years, it has been applied to a wiring material for wiring to a print head portion of a PC inkjet printer or a pick-up portion of CD-ROM drive, car navigation or DVD (digital versatile disc) player, etc.

FIGS. 7 and 8 are schematic cross-sectional views showing an example of a conventional flexible flat cable. As shown in FIG. 7, the conventional flexible flat cable 100 is manufactured such that single or plural parallel-arranged conductors 101 as a signal line are formed into a group of conductors, sandwiched by two insulating films 103 with adhesive 102 adhered to the surface thereof, and processed by thermocompression etc. A reinforcing plate 104 for lining each conductor exposed may be provided at both ends of the flexible flat cable 100, as shown in FIG. 8.

On the other hand, for the purpose of magnetic shield, a flexible flat cable with a shield layer formed by coating with a shield material the insulating film 103 of the flexible flat cable 100 shown in FIG. 7 is applied to electric and electronic devices including audio-video devices such as VTR, CD player or DVD player and office automation devices such as photocopier, scanner or printer. For example, the shield material may have a multilayer structure comprised of an adhesive having conductive properties, a metal material having conductive properties, and an insulating film having insulation properties. The adhesive having conductive properties may be generally an adhesive with conductive fine particles called conductive fillers such as Ni or carbon added thereto.

More recently, along with the popularization of digital devices such as liquid crystal display television or plasma television, a wiring material for high-speed and high-capacity transmission is demanded. Therefore, the demand for the flexible flat cable having a shield layer which can be matched to characteristic impedance of the digital device has been increasing. Such a flexible flat cable having a shield layer in which characteristic impedance is possible includes, e.g., a flexible flat cable configured to have a specific conductor width or distance between each conductor (e.g., see JP-A 2002-184245), a flexible flat cable in which an insulating film is formed of a foam insulator, and a flexible flat cable in which an air-containing layer formed of a nonwoven fabric is provided on an outer surface of an insulating film (e.g., see JP-A 2003-31033, JP-A 2005-339833 and JP-A 2008-277254).

In the conventional flexible flat cable described in the prior art documents, etc., an effective means for matching the characteristic impedance is to control a width of a conductor having a rectangular cross section (a flat shape) or a distance between each conductor, or to apply a foam insulator, etc., having low dielectric constant. However, since flexibility of the flexible flat cable may be insufficient by these means, it is not necessarily possible to satisfy the demand for the flexible flat cable accompanied with downsizing and space saving of the latest electric and electronic devices.

For example, in recent years, accompanied with downsizing and space saving, etc., of the electric and electronic devices, when a flexible flat cable is wired to an electric and electronic device, there is a case that the flexible flat cable is bent 180° and is wired while maintaining the shape. However, the conventional flexible flat cable does not have sufficient flexibility to maintain a 180-degree bent shape, thus, there is a problem that, even though it is bent, it is not possible to maintain the bent shape. Particularly in a flexible flat cable having a shielded layer, there is concern that the shield layer causes a decrease in flexibility.

SUMMARY OF THE INVENTION

Therefore, it is an object of the invention to provide a flexible flat cable which solves the above-mentioned problems, can be matched to characteristic impedance of the device, and has improved flexibility compared with the conventional art.

(1) According to one embodiment of the invention, a flexible flat cable comprises:

a plurality of conductors arranged parallel at predetermined intervals;

an insulation layer covering both sides of each of the plurality of conductors;

a nonwoven fabric layer on an outer surface of the insulation layer; and a shield layer on an outer surface of the nonwoven fabric layer, wherein the nonwoven fabric layer comprises a nonwoven fabric comprising a layer comprising a first fiber thread with a predetermined outer diameter and a second fiber thread with an outer diameter larger than that of the first fiber thread, and a basis weight of the nonwoven fabric is 50 to 90 $g/m^2$.

In the above embodiment (1) of the invention, the following modifications and changes can be made.

(i) The nonwoven fabric comprises a first layer comprising the first fiber thread, a second layer comprising the second fiber thread and formed on both sides of the first layer, and a third layer comprising the first and second fiber threads and formed between the first and second layers.

(ii) A void content of the nonwoven fabric is 170 to 280 $cm^3/m^2$.

(iii) The shield layer comprises a shield material including metal foil wound around the nonwoven fabric layer.

(iv) The insulation layer comprises an insulating film comprising one of polyethylene terephthalate, polyethylene naphthalate and polyphenylene sulfide, and an insulating and flame-retardant adhesive applied onto a surface of the insulating film.

POINTS OF THE INVENTION

According to one embodiment of the invention, a flexible flat cable is constructed as next. A first layer formed of a first fiber thread is provided inside the nonwoven fabric. Second layers are provided on both sides of the first layer at portions not contacting the first layer. The second layer is formed of a second fiber thread having an outer diameter larger than that of the first fiber thread, and is a layer to be a surface (outer surface) of the nonwoven fabric. Furthermore, a third layer formed from the mixing of the first and second fiber threads is provided between the first layer and the second layer in the nonwoven fabric. Since it is possible to efficiently adjust the dielectric constant and density of the nonwoven fabric by using the nonwoven fabric, it is possible to simultaneously achieve the characteristic impedance matching and the flexibility improvement of the flexible flat cable.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

An embodiment of the invention will be described below in conjunction with the appended drawings. However, the invention is not limited to the embodiment described herein, and combinations or modifications may be appropriately made without changing the scope of the invention.

As a result of the keen examination, the present inventors have found that forming a nonwoven fabric layer in the flexible flat cable from a material having low dielectric constant and density, etc., of the material are important to achieve characteristic impedance matching and improvement in flexibility which are objects of the invention, and thus, the present invention was made based on this knowledge.

In other words, the invention provides a flexible flat cable provided with plural conductors arranged in parallel at predetermined intervals, an insulation layer for covering both sides of the conductor, a nonwoven fabric layer provided on an outer surface of the insulation layer and a shield layer provided on an outer surface of the nonwoven fabric layer, wherein the nonwoven fabric layer is formed of a nonwoven fabric having a layer formed of a first fiber thread having a predetermined outer diameter and a second fiber thread having an outer diameter larger than that of the first fiber thread, and basis weight of the nonwoven fabric is 50-90 g/m$^2$.

Figure 1:
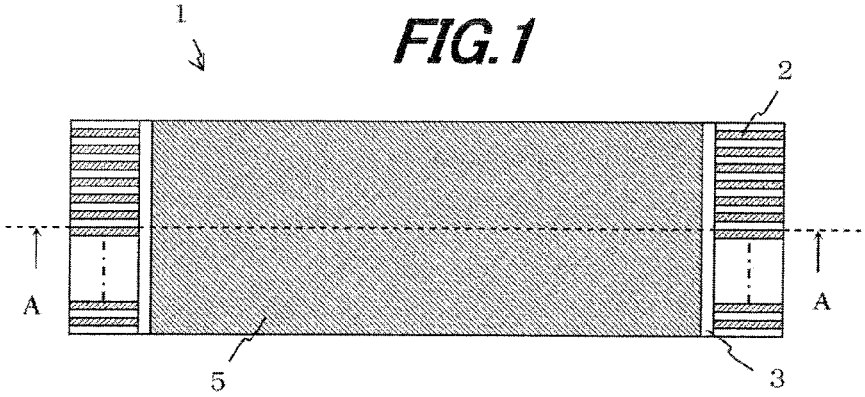
FIG. 1 is a schematic plan view showing a flexible flat cable in an embodiment.
Figure 2:
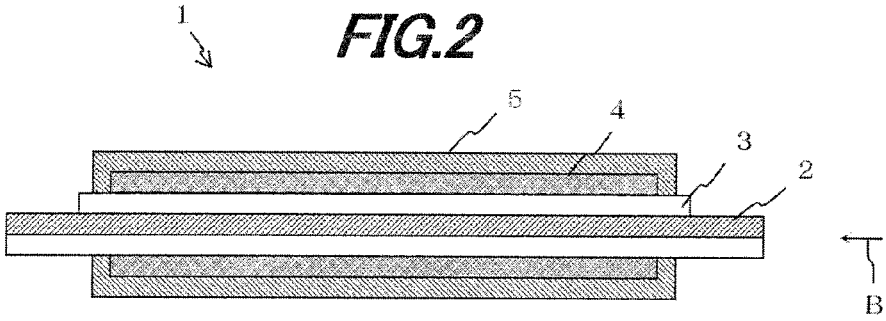
FIG. 2 is a cross sectional view taken along line A-A in FIG. 1.
Figure 3:
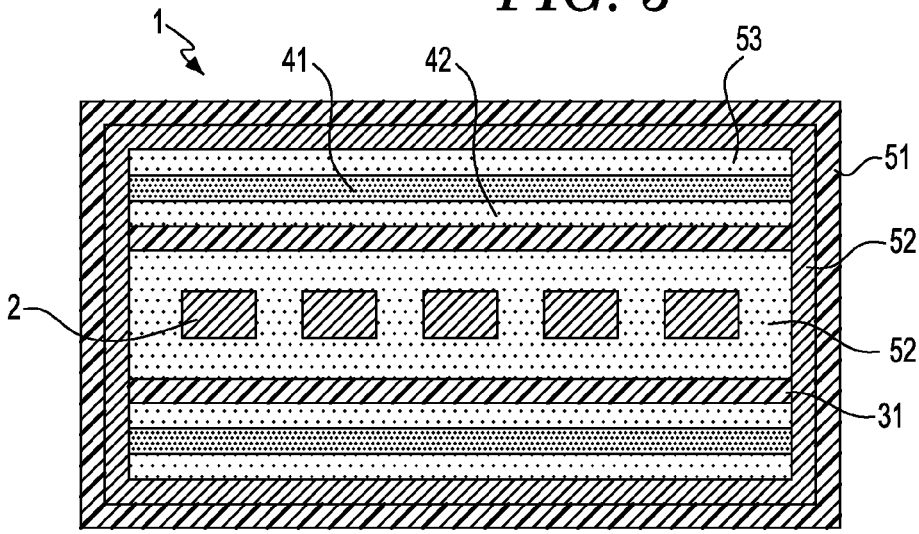
FIG. 3 is an enlarged cross sectional view as viewed from a B direction in FIG. 2.

FIG. 1 is a schematic plan view showing a flexible flat cable in the embodiment, FIG. 2 is a cross sectional view taken along line A-A in FIG. 1 and FIG. 3 is an enlarged cross sectional view as viewed from a B direction in FIG. 2.

As shown in FIGS. 1 and 2, in a flexible flat cable 1 in the present embodiment, plural conductors 2 used as a signal line or an grounding wire are arranged in parallel and an insulation layer 3 is provided on both sides of the conductors 2 so as to cover the conductors 2. In addition, a nonwoven fabric layer 4 is provided on an outer surface of the insulation layer 3, and a shield layer 5 is provided on an outer surface of the nonwoven fabric layer 4.

Insulation Layer

The insulation layer 3 is formed of an insulating film with adhesive which is an insulating film 31 made of plastic having an adhesive 32 attached to the surface thereof. As shown in FIG. 3, the insulation layer 3 is formed of the insulating films with adhesive which sandwich the conductor 2 from both sides (a vertical direction in FIG. 3) so that the adhesive 32 adheres to the conductor 2. The material for the insulating film 31 includes, e.g., polyethylene terephthalate (PET), polyethylene naphthalate (PEN) and polyphenylene sulfide (PPS), etc., and it is desirable to use any one of the above. In addition, it is desirable that an adhesive having, e.g., both of insulation properties and flame retardancy is used as the adhesive 32. It is desirable to use an adhesive in which an additive such as a flame retardant is added to, e.g., polyester resin or polyolefin resin.

Shield Layer

As shown in FIG. 3, the shield layer 5 is formed of a shield material in which a metal foil 52 is provided on a surface of an insulating film 51 made of plastic and an adhesive 53 is provided on a surface of the metal foil 52. The shield layer 5 is formed by, e.g., winding the shield material around the surface of the nonwoven fabric layer 4 such that the adhesive 53 of the shield material is in contact with the nonwoven fabric layer 4 and that the insulating film 51 becomes the outermost layer. Similarly to the material of the insulating film 31 which composes the insulation layer 3, the material of the insulating film 51 includes, e.g., polyethylene terephthalate, polyethylene naphthalate and polyphenylene sulfide, etc., and it is desirable to use any one of the above. In addition, similarly to the adhesive 32 which composes the insulation layer 3, it is desirable that an adhesive having both of insulation properties and flame retardancy, such as an adhesive in which an additive such as flame retardant is added to polyester resin or polyolefin resin, is used as the adhesive 53. When a structure, in which the flexible flat cable 1 is grounded to a ground metal layer at an end portion thereof, is employed at the time of winding the shield material, it is desirable to use an adhesive having conductive properties as the adhesive 53.

Aluminum foil is preferable as a material for the metal foil 52 in order to suppress an increase in attenuation especially in a high-frequency band. Since the attenuation in the high-frequency band may be increased when a shield material other than the aluminum foil is used, it is preferable to use the metal foil 52 made of the aluminum foil as a shield material in a flexible flat cable which is used in the high-frequency band, especially used in a frequency band of 1-5 GHz. Alternatively, as a shield material other than a metal foil, it is possible to use a shield material having a metal deposited layer formed by depositing aluminum or silver on the insulating film 51.

The thickness of the metal foil 52 is preferably 20 μm or less from the viewpoint of the improvement in flexibility. Particularly, 7 μm or less is more preferable when taking the cost, etc., into consideration.

Nonwoven Fabric Layer

Figure 4:
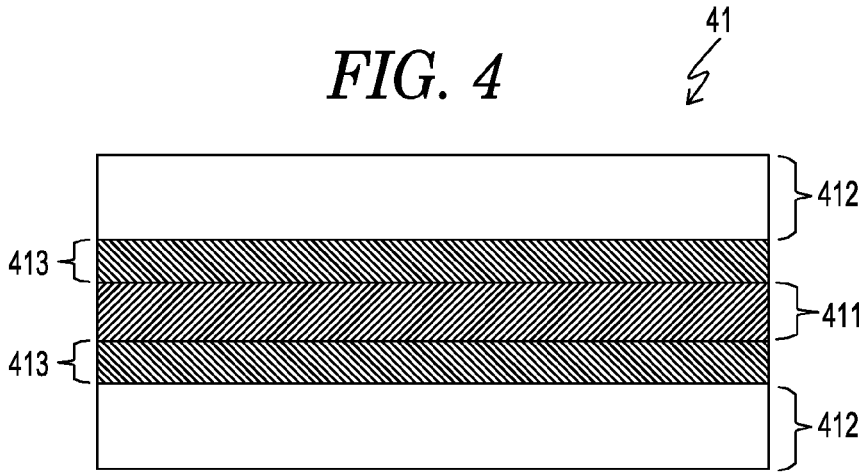
FIG. 4 is an enlarged cross sectional view showing a nonwoven fabric which composes the flexible flat cable in the embodiment.

As shown in FIG. 4, the nonwoven fabric layer 4 is formed of a nonwoven fabric 41 having an adhesive 42 provided on the surface thereof. As the adhesive 42, it is desirable to use an adhesive having both of insulation properties and flame retardancy, such as an adhesive in which an additive such as flame retardant is added to, e.g., polyester resin or polyolefin resin. The nonwoven fabric layer 4 is formed so that the adhesive 42 adheres to the insulation layer 3. In addition, the nonwoven fabric 41 has a layer formed of a first fiber thread having a predetermined outer diameter and a second fiber thread having an outer diameter larger than that of the first fiber thread. The first and second fiber threads are made of, e.g., polyester fiber, etc.

FIG. 4 is an enlarged cross sectional view for explaining the configuration of the nonwoven fabric 41.

As shown in FIG. 4, a first layer 411 formed of the first fiber thread is provided in a middle of the nonwoven fabric 41. Then, second layers 412 are provided on both sides of the first layer 411 at portions not in contact with the first layer 411. The second layer 412 is formed of the second fiber thread having the outer diameter larger than that of the first fiber thread, and is a layer to be a surface (outer surface) of the nonwoven fabric 41. Furthermore, as shown in FIG. 4, a third layer 413 formed from the mixing of the first and second fiber threads is provided between the first layer 411 and the second layer 412 in the nonwoven fabric 41. Since it is possible to efficiently adjust the dielectric constant and density of the nonwoven fabric 41 by using the nonwoven fabric 41 as described above, it is possible to simultaneously achieve the characteristic impedance matching and the flexibility improvement of the flexible flat cable 1.

The outer diameter (fiber diameter) of the first fiber thread which composes the first layer 411 and the third layer 413 is desirably not less than 0.001 mm and not more than 0.010 mm. Meanwhile, the outer diameter (fiber diameter) of the second fiber thread which composes the second layer 412 and the third layer 413 is desirably not less than 0.011 mm and not more than 0.040 mm.

In addition, the nonwoven fabric 41 preferably has basis weight of 50-90 g/m$^2$ in order to match the characteristic impedance and to improve the flexibility. When the basis weight of the nonwoven fabric 41 is less than 50 g/m$^2$, the flexibility is improved because it is possible to thin the nonwoven fabric 41, however, there is a possibility that the characteristic impedance does not fall within the range of 100±10Ω, hence, it is difficult to match the characteristic impedance to that of the device. On the other hand, when the basis weight of the nonwoven fabric 41 is more than 100 g/m$^2$, although the characteristic impedance easily falls within the range of 100±10Ω, the nonwoven fabric 41 is thickened with an increase in the basis weight, thus, the flexibility decreases. It should be noted that the basis weight as used herein indicates the mass of the total of the first fiber thread and the second fiber thread per square meter.

In addition, it is desirable that the nonwoven fabric 41 has a void content of 170-280 cm$^3$/m$^2$. This allows the dielectric constant of the nonwoven fabric 41 to fall within the range of 1.4-1.7. As a result, in the case where the basis weight of the nonwoven fabric 41 is 50-90 g/m$^2$, when the dielectric constant is within the range of 1.4-1.7, the value of the characteristic impedance of the flexible flat cable 1 can be within the range of 100±10Ω with good reproducibility. The void content of the nonwoven fabric is a measure of the void included in the nonwoven fabric per square meter and indicates a ratio of volume of the void included in the nonwoven fabric to the total volume of the nonwoven fabric.

Since the nonwoven fabric generally used in the flexible flat cable has microscopic voids, if liquid (e.g., water or adhesive) or powder in fine particle form adheres to the surface of the nonwoven fabric, those substance may penetrate into the nonwoven fabric and reach the surface opposite to the surface to which the liquid, etc., adheres. In such a case, there is concern that a problem arises in which the desired characteristic impedance is not obtained due to variation in the dielectric constant of the nonwoven fabric. In contrast, in the present embodiment, since the penetration of the liquid, etc., can be effectively blocked by the first or third layer formed in the vicinity of the intermediate portion of the nonwoven fabric 41 by configuring the nonwoven fabric 41 so as to have the structure shown in FIG. 4, it is possible to prevent the liquid, etc., from reaching the opposite third layer 413 even when the liquid, etc., adheres to the surface of the nonwoven fabric 41 (the surface of the third layer 413).

EXAMPLES

Although the invention will be explained in further detail as follows based on Examples, the invention is not limited thereto. The below-described Table 1 shows the configuration and the size of the flexible flat cables in Examples 1-3 and Comparative Examples 1-3.

Fabrication in Examples 1-3 and Comparative Examples 1 and 2

Fifty one tin-plated soft copper flat wires each having a thickness of 0.035 mm and a width of 0.3 mm were prepared as conductors, the conductors were arranged in parallel with a conductor pitch (a distance between each conductor) of 0.5 mm and an insulation layer was subsequently formed sandwiching the conductor arranged parallel by two 0.06 mm thick insulating films made of polyethylene terephthalate having an adhesive attached thereon so that adhesives are bonded each other, and then, a nonwoven fabric layer was formed sandwiching the insulation layer from both sides by two nonwoven fabrics having desired basis weight and void content so that the surfaces of the nonwoven fabrics to which the adhesive adheres are in contact with the insulation layer, and subsequently, a shield layer was formed by helically winding a shield material (adhesive/aluminum foil/insulating film=0.01 mm/0.007 mm/0.009 mm) around the nonwoven fabric layer, thereby fabricating a flexible flat cable having a cable length of about 300 mm.

A nonwoven fabric having a structure such as shown in FIG. 4 was used for nonwoven fabric layers of Examples 1-3 and Comparative Examples 1 and 2. In detail, the nonwoven fabric, in which a first layer formed of a first fiber thread having an outer diameter of 0.001-0.010 mm is provided at a center and a second layer formed of a second fiber thread having an outer diameter of 0.011-0.040 mm is provided on both sides of the first layer at a portion to be an outermost layer and a third layer formed from the mixing of the first and second fiber threads is provided between the first and second layers, was used. In addition, a flame retardant, etc., for satisfying the VW-1 test of the UL standard was added to the adhesive which composes an insulator layer.

Fabrication in Comparative Example 3

Fifty one tin-plated soft copper flat wires each having a thickness of 0.035 mm and a width of 0.5 mm were prepared as conductors, the conductors were arranged in parallel with a conductor pitch of 1.0 mm and an insulation layer was subsequently formed sandwiching the conductor arranged parallel by two 0.18 mm thick insulating films made of foam insulator having an adhesive attached thereon so that adhesives are bonded each other, and then, a shield layer was formed by helically winding a shield material (adhesive/aluminum foil/insulating film=0.01 mm/0.007 mm/0.009 mm) around the nonwoven fabric layer, thereby fabricating a flexible flat cable having a cable length of about 300 mm. A flame retardant, etc., for satisfying the VW-1 test of the UL standard was added to the adhesive which composes an insulator layer.

The following measurements and tests were conducted on the flexible flat cables fabricated as described above (Examples 1-3 and Comparative Examples 1-3).

Characteristic Impedance Measurement

Figure 5:
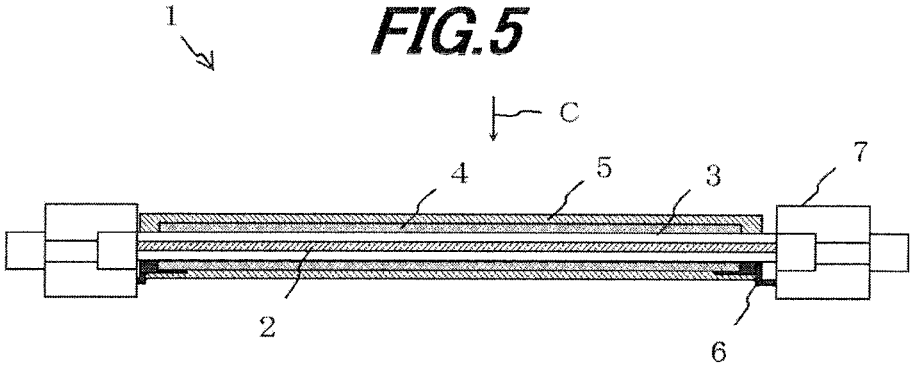
FIG. 5 is a view showing a state that a measuring plug is connected to an end of the flexible flat cable.
Figure 6:
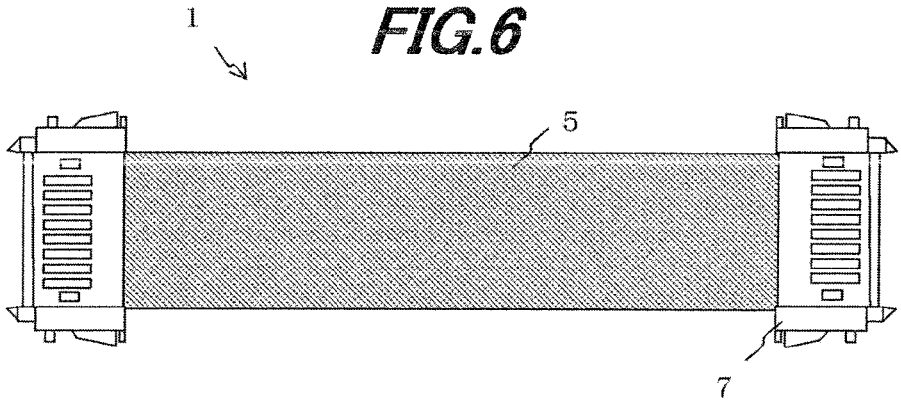
FIG. 6 is an enlarged cross sectional view as viewed from a C direction in FIG. 5.
Figure 7:
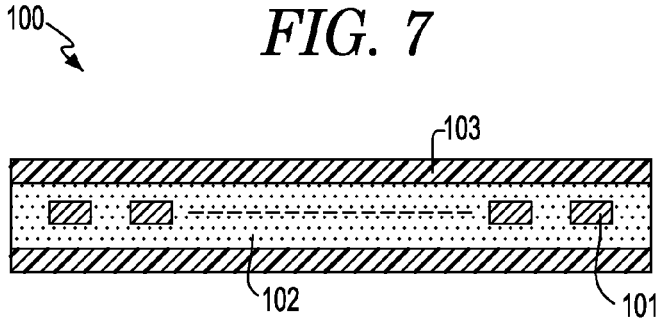
FIG. 7 is a schematic plan view showing an example of a conventional flexible flat cable.
Figure 8:
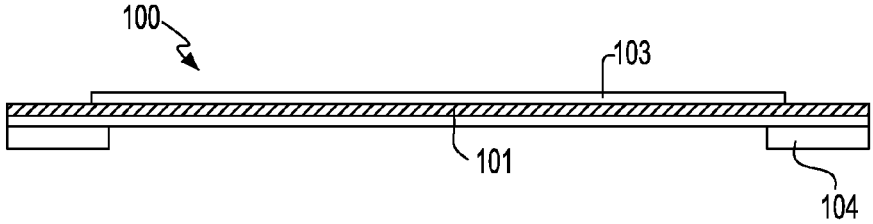
Prior Art FIG. 8
FIG. 8 is a schematic plan view showing an example of a conventional flexible flat cable.

For measuring the characteristic impedance, after ground metal layers 6 as shown in FIG. 5 were attached to both ends of the fabricated flexible flat cable, a measuring plug 7 (FX16M1/51, manufactured by Hirose Electric Co., Ltd.) was electrically connected to the ground metal layer 6 as shown in FIGS. 5 and 6. After that, the flexible flat cable was inserted between two evaluation substrates and was connected, and the characteristic impedance in differential mode was measured by an oscilloscope (DCA86100UB, manufactured by Agilent Technologies). The characteristic impedance value obtained by the measurement of this time falling within a range of 100±10Ω was judged as passed.

Bending Stress Test

In the bending stress test, the fabricated flexible flat cable was bent 180°, and a stress generated in the flexible flat cable when releasing the bent state was measured by a push-pull scale. Less than 260 gf/FFC width of the stress value obtained by the measurement of this time was judged as passed. The FFC width is a dimension of the flexible flat cable in a width direction (a vertical direction in FIG. 1).

The Table 1 shows the configuration, the size and the measurement evaluation result of the flexible flat cables in Examples 1-3 and Comparative Examples 1-3. In Table 1, the judgments is indicated by a double circle (◎) for the excellent result, a single circle (○) for the passed result and X for the failed result.

TABLE 1

| | Item | Unit | Example 1 | Example 2 | Example 3 | Comparative Example 1 | Comparative Example 2 | Comparative Example 3 |
|---|---|---|---|---|---|---|---|---|
| Structure of flexible flat cable | Conductor width | (mm) | 0.3 | 0.3 | 0.3 | 0.3 | 0.3 | 0.5 |
| | Conductor pitch | (mm) | 0.5 | 0.5 | 0.5 | 0.5 | 0.5 | 1.0 |
| | Insulating film with adhesive (Thickness) | (mm) | 0.06 | 0.06 | 0.06 | 0.06 | 0.06 | — |
| | Basis weight of nonwoven fabric | ($g/m^2$) | 50 | 70 | 90 | 40 | 100 | — |
| | Void content of nonwoven fabric | ($cm^3/m^2$) | 170 | 229 | 280 | 163 | 290 | — |
| | Dielectric constant of nonwoven fabric | — | 1.65 | 1.52 | 1.42 | 1.77 | 1.37 | — |
| | Foam insulator (Thickness) | (mm) | — | — | — | — | — | 0.18 |
| | Shield material (Thickness) | (mm) | 0.026 | 0.026 | 0.026 | 0.026 | 0.026 | 0.026 |
| Evaluation | Characteristic impedance | (Ω) | 90-92 | 95-97 | 98-100 | 85-87 | 101-103 | 99-101 |
| | Bending stress | (gf/FFC width) | 201 | 232 | 256 | 183 | 278 | 531 |
| | Judgment | — | ◎ | ○ | ○ | X | X | X |

As shown in Table 1, it is understood that both of the characteristic impedance and the bending stress satisfy the target value in Examples 1-3 in which a nonwoven fabric having a structure shown in FIG. 4 of which basis weight is 50-90 $g/m^2$ and the void content is 170-280 $cm^3/m^2$ is used.

In contrast, in Comparative Example 1 in which the nonwoven fabric has the basis weight of less than 50 $g/m^2$ and the void content of less than 170 $cm^3/m^2$, it is understood that the dielectric constant does not fall within the range of 1.4-1.7 and the characteristic impedance does not satisfy the target value. In addition, it is understood that the bending stress does not satisfy the target value in Comparative Example 2 in which the nonwoven fabric has the basis weight of more than 90 $g/m^2$ and the void content of more than 280 $cm^3/m^2$ and in Comparative Example 3 in which the nonwoven fabric layer is not provided.

This verifies that the flexible flat cables in Examples 1-3 of the invention can be matched to the characteristic impedance of the device and has flexibility more excellent than the conventional art.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A flexible flat cable, comprising:

a plurality of conductors arranged parallel at predetermined intervals;

an insulation layer covering both sides of each of the plurality of conductors;

a nonwoven fabric layer on an outer surface of the insulation layer; and a shield layer on an outer surface of the nonwoven fabric layer, wherein the nonwoven fabric layer comprises a nonwoven fabric comprising a layer comprising a first fiber thread with a predetermined outer diameter and a second fiber thread with an outer diameter larger than that of the first fiber thread, and a basis weight of the nonwoven fabric is 50 to 90 $g/m^2$.

2. The flexible flat cable according to claim 1, wherein the nonwoven fabric comprises a first layer comprising the first fiber thread, a second layer comprising the second fiber thread and formed on both sides of the first layer, and a third layer comprising the first and second fiber threads and formed between the first and second layers.

3. The flexible flat cable according to claim 1, wherein a void content of the nonwoven fabric is 170 to 280 $cm^3/m^2$.

4. The flexible flat cable according to claim 1, wherein the shield layer comprises a shield material including metal foil wound around the nonwoven fabric layer.

5. The flexible flat cable according to claim 1, wherein the insulation layer comprises an insulating film comprising one of polyethylene terephthalate, polyethylene naphthalate and polyphenylene sulfide, and an insulating and flame-retardant adhesive applied onto a surface of the insulating film.

* * * * *